United States Patent [19]

Yamazaki et al.

[11] 4,166,610

[45] Sep. 4, 1979

[54] VACUUM CARBURIZING FURNACE

[75] Inventors: Katsuhiro Yamazaki, Tanashi; Katsuro Nakamura, Tokyo; Kiyotaka Miyake, Higashi-yamato, all of Japan

[73] Assignee: Ishikawajima-Harima Jukogyo Kabushiki Kaisha, Tokyo, Japan

[21] Appl. No.: 834,978

[22] Filed: Sep. 20, 1977

[30] Foreign Application Priority Data

Oct. 28, 1976 [JP] Japan ..... 51-129622

[51] Int. Cl.[2] ..... C21D 1/74

[52] U.S. Cl. ..... 266/89; 266/252

[58] Field of Search ..... 266/80, 81, 82, 85, 266/89, 250, 252

[56] References Cited

U.S. PATENT DOCUMENTS

| | | | |
|---|---|---|---|
| 2,818,246 | 12/1957 | Kappel | 266/81 |
| 2,886,478 | 5/1959 | Beard | 266/80 X |
| 3,025,044 | 3/1962 | Giler | 266/250 |
| 3,041,058 | 6/1962 | Straumann et al. | 266/89 X |
| 3,782,705 | 1/1974 | Westeren et al. | 266/250 X |

FOREIGN PATENT DOCUMENTS

| | | | |
|---|---|---|---|
| 4723051 | 6/1972 | Japan | 266/80 |

*Primary Examiner*—Howard N. Goldberg
*Assistant Examiner*—Paul A. Bell
*Attorney, Agent, or Firm*—Scrivener, Parker, Scrivener & Clarke

[57] ABSTRACT

A vacuum carburizing furnace wherein the concentration of carburizing gas in the furnace atmosphere as well as the furnace pressure may be maintained within predetermined ranges for optimum carburization, and the carburizing atmosphere is forced to circulate by a fan within the heating chamber so that parts or articles may be uniformly carburized.

4 Claims, 6 Drawing Figures

VACUUM CARBURIZING FURNACE

DETAILED DESCRIPTION OF THE INVENTION

The present invention relates to a vacuum gas carburizing furnace.

According to the gas carburizing method, which is one of the methods for surface hardening of metals, a reaction gas generated by an endothermic gas generator is used as a carrier gas for carrying a small quantity of $C_3H_8$ (or $C_4H_{10}$) into a carburizing furnace in order to effect the gas carburization of articles or parts. However the conventional gas carburizing method has some problems. First the time required for the carburizing furnace to rise to a carburizing temperature is too long; the carburizing conditions are worse; and it takes a long time to give a desired core depth. Therefore there has been an increasing demand for a gas carburizing method which may give a desired core depth within a short time and which will not give rise to atmospheric pollution problems.

To this end there has been devised and demonstrated a vacuum carburizing method which may give a desired core depth within a short time. According to this method, a live gas such as $CH_4$ (or $C_3H_8$) is directly fed into a furnace which is normally heated to a temperature higher than 1,000° C. and is evacuated so that gas carburizing may be effected under a reduced pressure.

When $CH_4$ is fed into the furnace which is heated at a temperature higher than 1,000° C. and under a reduced pressure, $CH_4$ thermally breaks down as follows:

$$CH_4 \rightarrow C + 2H_2$$

Carbon thus liberated is imparted into the surface of an article. As a result of the above thermal decomposition, $CH_4$ is converted into $2H_2$ having the volume twice as much as the initial volume of $CH_4$ so that as the thermal decomposition proceeds, the furnace pressure increases accordingly.

When a predetermined volume of $CH_4$ is fed into and left in the vacuum carburizing furnace at a high temperature and under a reduced pressure, $CH_4$ (an additive gas) is completely decomposed, and the decomposition speed or rate is dependent upon the volume of $CH_4$ charged into the furnace. Therefore during gas carburizing process the flow rate of $CH_4$ gas to be fed into the furnace must be so controlled that the concentration of carbon deposited on the surfaces of parts or articles to be carburized may be always maintained at a predetermined level and the liberation of an excessive amount of carbon in the form of soot must be avoided. To this end, the concentration of $CH_4$ remaining in the carburizing furnace as well as the furnace pressure must be closely maintained within desired ranges, respectively. To this end, the flow rate of $CH_4$ to be fed into the vacuum carburizing furnace must be so controlled that its concentration in the furnace may be always maintained within a desired range, and the mixture of gases ($CH_4$, $H_2$, etc.) within the furnace must be exhausted out of the furnace so that the furnace pressure may be prevented from increasing above a predetermined level.

The conventional vacuum gas carburizing method may be divided into two types. In one type a carburizing gas is continuously fed from a source into the furnace while the gas in the furnace being discharged. In the other type the charging and discharging of a carburizing gas are effected alternately. When a heating chamber of the gas carburizing furnace is not provided with mechanical means for forcibly circulating the carburizing gas atmosphere, the carburizing gas is discharged out of the furnace before it has been sufficiently circulated within the furnace. As a result, the core depth varies from one part to another.

Opposed to the prior art gas carburizing method, the vacuum gas carburizing method is carried out in the gas atmosphere at a temperature higher than 1,000° C. so that it has been considered among those skilled in the art that the forced recirculation of the furnace atmosphere is impossible. That is, even when a fan made of a metal is placed in the furnace atmosphere at a high temperature and under a reduced pressure, its durability or service lifetime would be very short because of the creep, the carburization and the cyclic stress variation due to the cyclic heating and cooling. Thus so far no fan has been placed in the carburizing furnace.

Meanwhile, the furnace pressure in the conventional gas carburizing furnaces is in general higher than the surrounding atmospheric pressure so that the inflammable gas is always discharged through a discharge port out of the furnace and is burned at the discharge port in order to avoid the explosion of the discharged gas. On the other hand, the atmospheric pressure in the vacuum carburizing furnaces is always lower than the surrounding atmospheric pressure so that when a leakage occurs, the surrounding air is sucked into the furnace. Therfore, the vacuum carburizing furnace must be vacuumtightly sealed against the surrounding atmosphere. When a fan which agitates and circulates the carburizing atmosphere within the vacuum carburizing furnace is driven by a prime mover disposed exterior of the vacuum carburizing furnace, the vacuumtight sealing of the rotating shaft of the fan extending through the furnace wall is extremely difficult so that the surrounding air will leak into the vacuum carburizing furnace, causing an explosion. Even if the explosion may be avoided, the leakage of air into the vacuum carburizing furnace will cause the variation in concentration of the carburizing atmosphere, thus adversely affecting the qualities of the products.

The present invention was therefore made to overcome the above and other problems encountered in the prior art vacuum carburizing method, and one of the objects of the present invention is to provide a vacuum carburizing furnace in which the concentration and pressure of the carburizing atmosphere within the furnace may be always maintained optimum for carburizing of metal parts.

Another object of the present invention is to provide a vacuum carburizing furnace which is simple in construction and inexpensive to manufacture by using an infrared analyzer and pressure responsive switches both of which may be readily available in the market so that an analog process control may be entirely eliminated.

A further object of the present invention is to provide a vacuum carburizing furnace which is easier and highly reliable in operation and which may produce the carburized products with uniform quality.

A further object of the present invention is to provide a vacuum carburizing furnace in which the high-temperature carburizing atmosphere is always circulated and convected so that the uniform concentration and temperature distributions of the carburizing atmosphere may be attained and consequently the parts may be uniformly carburized.

An yet another object of the present invention is to provide a vacuum carburizing furnace in which the furnace parts such as partition walls and so on as well as the blades of a fan disposed within the furnace all of which are subjected to the high-temperature carburizing atmosphere are made of materials highly resistant to heat so that the maintenance of the vacuum carburizing furnace may be easily effected at less cost.

A still further object of the present invention is to provide a vacuum carburizing furnace which may completely avoid an explosion of the high-temperature carburizing gas under a reduced pressure so that the safe operations may be ensured.

An additional object of the present invention is to provide a vacuum carburizing furnace which may operate at high speed for a long time even under a reduced pressure.

The present invention will become more apparent from the following description of one preferred embodiment thereof taken in conjunction with the accompanying drawings, in which.

Same reference numerals are used to designate similar parts throughout the figures.

Figure 1:
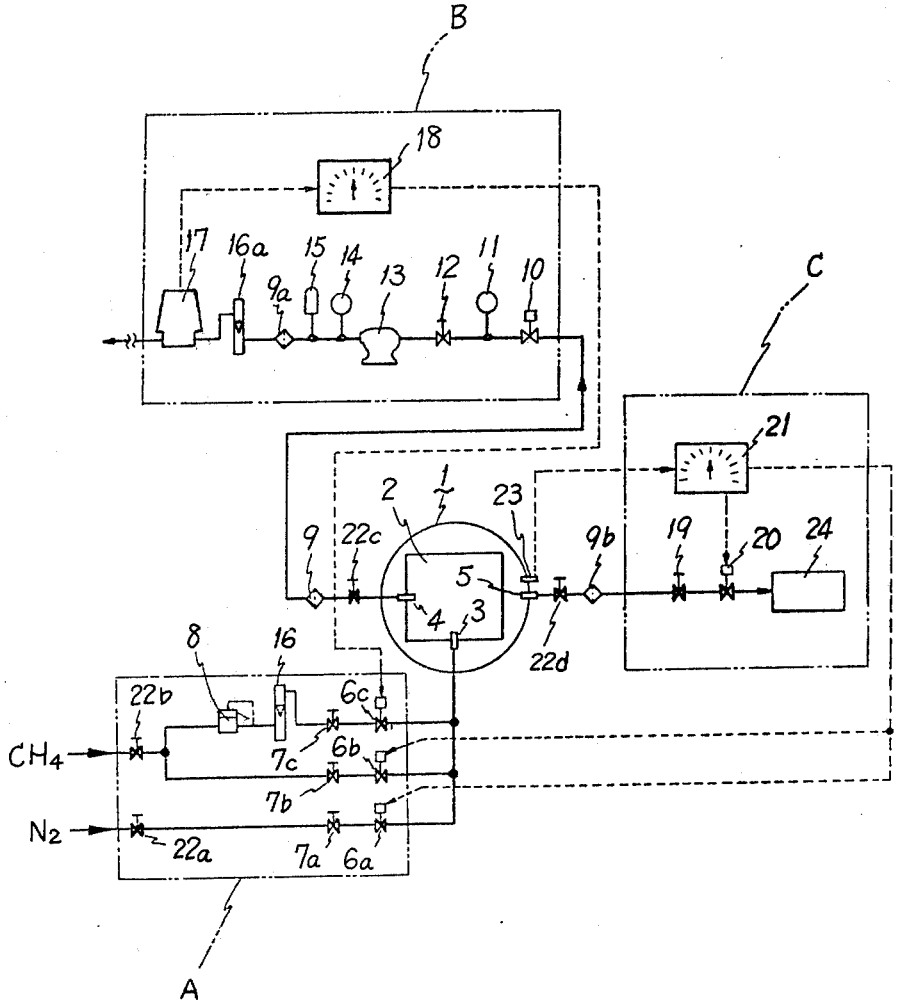
FIG. 1 is a diagram of a system for controlling the carburizing atmosphere in a vacuum carburizing furnace in accordance with the present invention.

First referring to FIG. 1 the furnace control system consisting of a gas feed control system A, a gas concentration control system B, a carburizing atmospheric pressure control system C and a temperature control system (not shown) will be described. A vacuum carburizing furnace generally indicated by the reference numeral 1 includes a heating chamber 2 into which are charged articles to be carburized. The gas feed control system A is communicated with a gas inlet or injection nozzle 3 opened at the bottom of the heating chamber 2; the gas concentration control system B is connected to a gas outlet 4 opened through one side wall of the heating chamber 2; and the atmospheric pressure control system C is communicated through an outlet 5 extended through the other side wall of the heating chamber 2, the system C being further connected to a pressure sensor 23 for detecting the pressure within the furnace 1.

The gas feed control system A is communicated through stop valves **22*a* and 22*b* with $N_2$ and $CH_4$ supply sources, respectively, and the stop valve 22*a* is communicated through a needle valve 7*a* and a solenoid-operated valve 6*a* to the gas inlet 3 while the discharge port of the stop valve 22*b* is communicated with two branched lines. One line is communicated through a needle valve 7*b* and a solenoid-operated valve 6*b* with the gas inlet 3 while the other line is communicated through a reducing valve 8, a flowmeter 16, a needle valve 7*c* and a solenoid-operated valve 6*c* to the gas inlet 3**.

The furnace gas outlet 4 is communicated through a stop valve **22*c*, a filter 9 with a solenoid-operated valve 10 in the atmosphere concentration control system B, and the valve 10 is communicated through a pressure gage 11, a needle valve 12, a pressure pump 13, a pressure gage 14, a relief valve 15, a filter 9*a* and a flowmeter 16*a* with an infrared analyzer 17 which discharges the furnace gas into the surrounding atmosphere and which is operatively coupled to an infrared analyzer controller 18**.

The concentration of $CH_4$ in the furnace gas or carburizing atmosphere is detected by the infrared analyzer and is compared with a reference value set in the controller 18. When the concentration detected is lower than the reference value, the controller 18 transmits the control signal to the solenoid-operated valve **6*c* in the gas feed control system A to open the valve 6*c***.

The furnace gas outlet 5 is communicated through a stop valve **22*d* and a filter 9*b* with a needle valve 19 in the pressure control system C which in turn is communicated through a solenoid-operated valve 20 with an exhaust device 24. The pressure sensor 23 is operatively coupled to a pressure controller 21 which in turn is connected to the solenoid-operated valve 20 and the solenoid-operated valves 6*a* and 6*b*** in the gas feed control system A.

The pressure controller 21 is activated in response to the carburization start signal to transmit the control signal to the solenoid-operated valve 20 so as to cause it to close prior to the feeding of the carburizing atmosphere into the furnace 1; that is, when the furnace pressure detected by the pressure sensor 23 is lower than a predetermined level. Concurrently, the pressure controller 21 sends the control signal to the solenoid-operated valve **6*a* in the $N_2$ or diluting gas supply line in the gas feed control system A so that the valve 6 is opened to feed $N_2$ into the furnace 1 until the furnace pressure reaches a predetermined level. When the pressure of the nitrogen gas fed into the furnace 1 exceeds the predetermined level, the pressure sensor 23 transmits the signal to the pressure controller 21 which in turn sends the control or closing signal to the solenoid-operated valve 6*a* to close it and concurrently transmits the control or opening signal to the solenoid-operated valve 6*b* in the $CH_4$ supply line in the control system A so that the the valve 6*b* is opened to feed $CH_4$ into the furnace. When the pressure of the carburizing atmosphere ($CH_4$ diluted with $N_2$) in the furnace exceeds a predetermined level, the pressure sensor transmits the signal to the pressure controller 21 which in turn transmits the control or closing signal to the solenoid-operated valve 6*b* and simultaneously sends the control or closing signal to the solenoid-operated valve 10 in the control system B so that the furnace gas is introduced into the concentration control system B. Thereafter as long as the furnace pressure is higher than a predetermined pressure level, the pressure controller 21 transmits the control or opening signal to the solenoid-operated valve 20 in the pressure control system C so that the valve 20** is kept opened and the furnace pressure is always maintained within a predetermined range.

Next the mode of operation of these control systems A, B, and C will be described. Prior to the vacuum carburizing, the stop valves **22*a*, 22*b*, 22*c* and 22*d* are wide opened while the degree of opening of each of the needle valves 7*a*, 7*b*, 7*c*, 12 and 19 is so controlled that the gas may flow at a predetermined flow rate in the feed or discharge line. Thereafter a start button is depressed to start the cyclic automatic vacuum carburizing operations. That is, in response to the control signal from the temperature control system (not shown), the solenoid-operated valves 6b, 6c, 10 and 20 are kept closed while only the solenoid-operated valve 6a is kept opened so that $N_2$ is introduced into the furnace 1 until the furnace pressure reaches a predetermined level in the manner described above. When the pressure of $N_2$ in the furnace 1 reaches a predetermined level, the solenoid-operated valve 6a is closed in response to the control signal from the pressure controller 21 in the manner described above while the solenoid-operated valve 6b is opened to introduce $CH_4$ into the furnace 1 until the pressure of the carburizing atmosphere ($N_2$ and $CH_4$) within the furnace 1 reaches a predetermined level. As a result, $CH_4$ is diluted with $N_2$ at a predetermined ratio within the furnace 1 so that the sooting or the excessive deposition of carbon in the form of soot on exposed surfaces of parts charged in the furnace 1 may be avoided. After the pressure of the carburizing atmosphere has reached a predetermined pressure level, the solenoid-operated valve 6b is closed in the manner described above while the solenoid-operated valve 10 in the concentration control system B is opened and the pressure pump 13 is driven, whereby the measurement of the $CH_4$ concentration in the carburizing atmosphere in the furnace 1** may be started.

The furnace gas under a reduced pressure is drawn and increased in pressure by the pressure pump 13, and is fed into the infrared analyzer 17 after the pressure of the drawn furnace gas has been maintained at a predetermined level by the relief valve 15. The infrared analyzer 17 detects the concentration of $CH_4$ in the furnace gas in terms of the number of $CH_4$ molecules so that as the pressure of the furnace gas varies, the detection of the same concentration also varies. However, in accordance with the present invention, the furnace gas under a reduced pressure is always raised to the pressure same with the surrounding atmospheric pressure before the furnace gas is introduced into the infrared analyzer 17 so that the concentration of $CH_4$ in the furnace gas may be detected always under the same conditions and consequently may be detected with a higher degree of accuracy.

The output of the infrared analyzer 17 representative of the $CH_4$ concentration in the furnace gas is transmitted to and compared in the concentration controller 18 with a reference value. When the concentration detected is lower than a reference value, the concentration controller 18 transmits the control or opening signal to the solenoid-operated valve 6c to open the same. Then, a predetermined amount of $CH_4$ whose pressure is reduced by the reducing valve 8 and whose flow rate is controlled by the needle valve 7c is introduced into the furnace 1 to restore the $CH_4$ concentration in the furnace gas or carburizing atmosphere to a predetermined level. When the $CH_4$ concentration has been restored in the manner described above, the solenoid-operated valve 6c is closed in response to the control signal from the concentration controller 18. Thus the $CH_4$ concentration in the carburizing atmosphere in the furnace 1 may be always maintained at a constant level by cycling the above concentration control steps.

As the thermal decomposition of $CH_4$ proceeds in the furnace 1, the furnace pressure increases. When the furnace pressure increases above a predetermined level, the pressure sensor 23 transmits the signal to the pressure controller 21 in the system C, and the controller 21 sends the opening signal to the solenoid-operated valve 20 to exhaust the furnace gas, thereby reducing the furnace pressure to a predetermined level. After the furnace pressure has been restored to a predetermined level in the manner described above, the valve 20 is closed in response to the control signal from the pressure controller 21. Thus the pressure of the carburizing atmosphere in the furnace 1 may be always maintained with a predetermined range by cycling the above pressure control steps.

Next referring to FIGS. 2, 3, 4, and 5 the construction of the vacuum carburizing furnace 1 will be described in detail. The vacuum carburizing furnace 1 includes double-walled vacuum vessel 34 consisting an outer shell 31, an inner shell 32 and a water jacket 33 defined between the outer and inner shells 31 and 32. The heating chamber 2 is disposed within the vacuum vessel 34. In general only after the vacuum vessel 34 has been evacuated to $10^{-3}$ to $10^{-4}$ Torr, a carburizing gas under reduced pressure is introduced in the heating chamber 2 so that no oxygen is permitted to intrude into the heating chamber 2. The heating chamber 2 is in the shape of a box having a top, a bottom, two opposed side walls, two opposed end walls and two inclined walls interconnecting between the top and the side walls. That is, the heating chamber 2 has an outer shell 35, an inner shell 42 and an heat insulating layer 36 sandwiched between the outer and inner shells 35 and 42. Resistance heating elements 37 are disposed in parallel with the ceiling or top and bottom of the heating chamber 2, spaced apart therefrom by a suitable distance and securely held in position by hangers 39 and insulators 40, respectively. These heating elements 37 are electrically connected to a power source through lead-in wires 44 extended through the walls of the heating chamber 2 and vacuum vessel 34.

Figure 3:
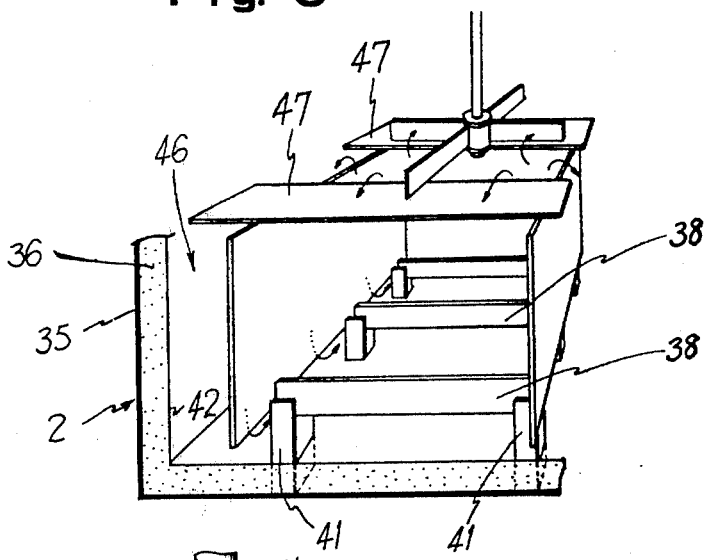
FIG. 3 is a fragmentary perspective view thereof mainly showing the construction of a heating chamber.

As best shown in FIG. 3, a batch container support structure consists of a plurality of spaced support beams 38 which in turn are supported at ends by supports 41 extended upwardly from the bottom of the heating chamber 2.

Figure 2:
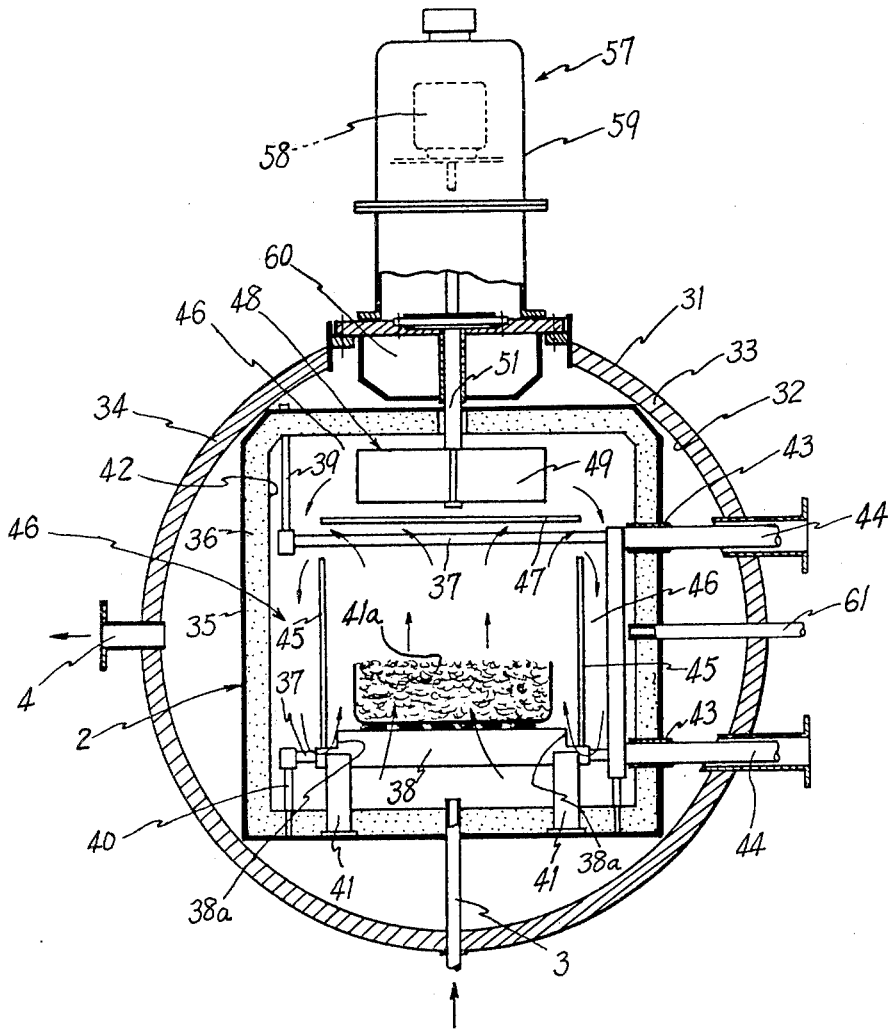
FIG. 2 is a sectional view of the vacuum carburizing furnace in accordance with the present invention.
Figure 4:
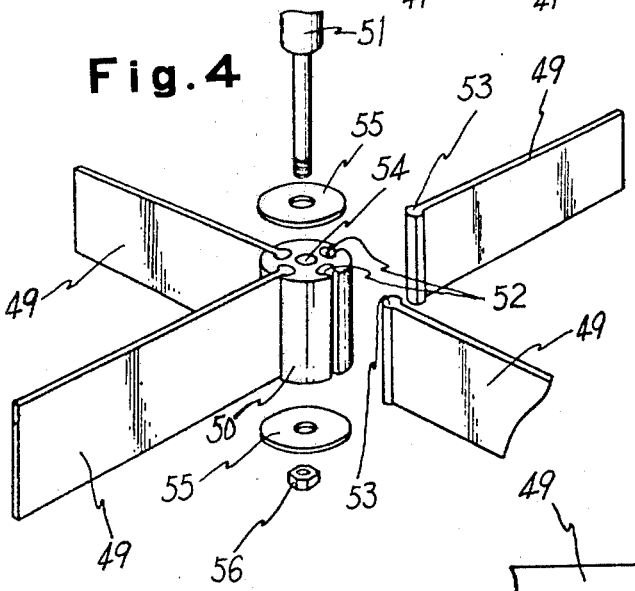
FIG. 4 is a partly exploded perspective view of a fan disposed within the heating chamber.

Referring to FIGS. 2 and 4, partition walls 45 pressed from a material such as a synthetic graphite free from carburization are erected vertically on cutout shoulder portions 38a (See FIG. 2) at the ends of the beams 38 and are spaced apart by a suitable distance from the side walls or interior shell 42 of the heating chamber 2 so that carburizing atmosphere circulation passages 46 may be defined. Ceiling plates 47 are interposed between the top of the heating chamber 2 and the upper edges of the partition walls 45. Thus the circulation passages 46 intercommunicates between the ceiling section defined above the ceiling plates 47 and the bottom section defined below the supporting beams 38 of the support structure.

Figure 5:
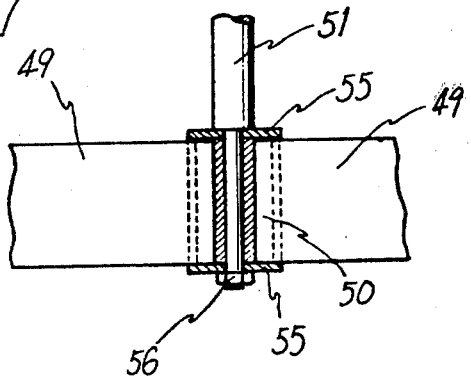
FIG. 5 is a fragmentary axial sectional view of the fan especially showing the joint between the rotating shaft, hub and blades of the fan.

Referring back to FIGS. 2 and 3, a fan generally indicated by the reference numeral 48 and comprised of blades 49, a hub 50 and a rotating shaft 51 is disposed in the ceiling section; that is, in the space between the top of the heating chamber 2 and the ceiling plates 47. The blades 49, the hub 50 and the rotary shaft 51 are all pressed or formed from a material such as a synthetic graphite not subjected to carburization. As best shown in FIGS. 4 and 5, the hub 50 is in the form of a cylinder or a disk and is formed with a central through hole 54 into which is fitted the lower end portion of the rotary shaft 51 and with a plurality (four in this embodiment) of peripherally equiangularly spaced slots 52. The bottom of each of these slots 52 is substantially circular in cross section as best shown in FIG. 4 so that the enlarged root 53 substantially circular in cross section of the blades 49 may be detachably fitted into the slots 52. After the blades 49 and the hub 50 are assembled into a unitary construction in the manner described above, the reduced diameter lower end portion of the rotary shaft 51 is fitted into the through hole 54 of the hub 50 with an upper washer 55 interposed between the upper end of the hub 50 and the stepped portion of the rotary shaft 51. Thereafter the lower washer 55 is fitted over the end portion of the rotary shaft 51 extended downwardly out of the central through hole 54 of the hub 50 and then a nut 56 is screwed over the rotary shaft 51. Thus the hub 50 and the rotary shaft 51 are securely joined to each other as best shown in FIG. 5. The fan 48 in accordance with the present invention is advantageous in that it may be easily assembled and dismantled and that it has sufficiently high strength because its parts are made of a reinforced synthetic graphite.

Figure 6:
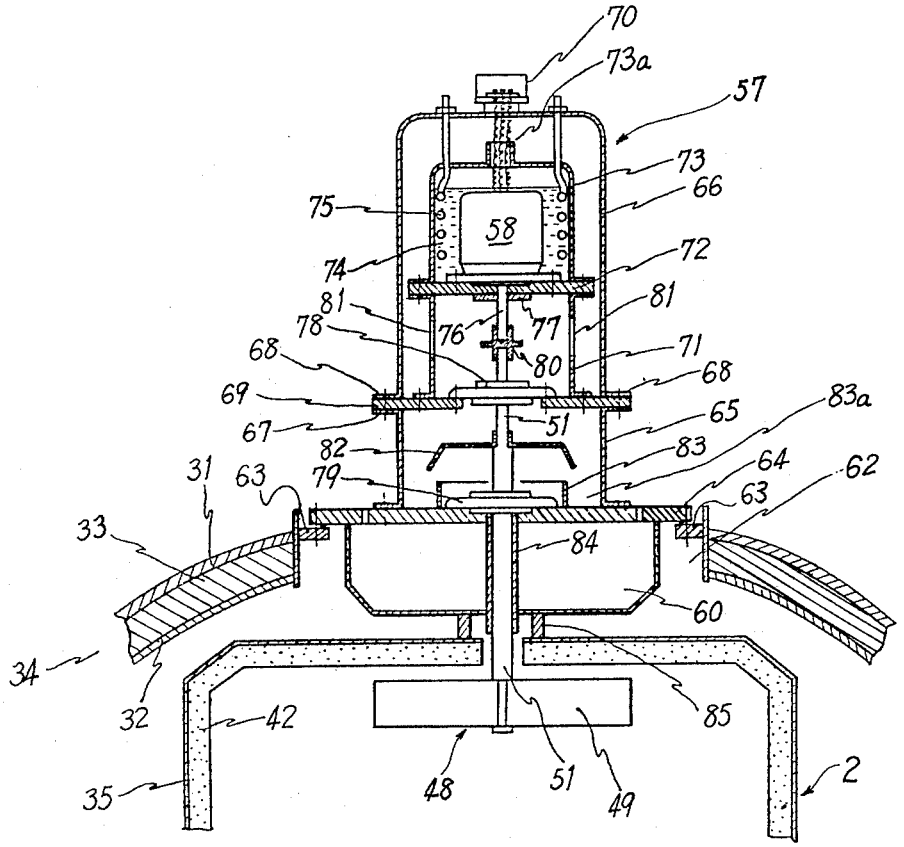
FIG. 6 is a fragmentary sectional view, on enlarged scale, of the vacuum carburizing furnace shown in FIG. 1 illustrating the mounting of the fan and a fan motor.

Referring back to FIG. 2, the rotary shaft 51 of the fan 48 is extended vertically upwardly through a hole formed through the top of the heating chamber, a water jacket 60 formed as a unitary construction with a top cover 64 of the vacuum vessel 34 and through a vacuum vessel generally indicated by the reference numeral 57 and is joined to a drive shaft of a fan motor 58 which is disposed in the vacuum chamber 57 as will be described in detail with particular reference to FIG. 6.

A sampling port 61 is provided in order to sample the carburizing atmosphere in the heating chamber 2.

Next the mode of operation of the vacuum carburizing furnace with the above construction will be described. As described above with reference to FIG. 1, $N_2$ and $CH_2$ gases are injected into the heating chamber 2 through the gas inlet or injection nozzle 3, and the concentration of $CH_4$ and the pressure and temperature of the carburizing atmosphere ($CH_4$ diluted with $N_2$) are maintained to carburize parts 41*a* placed on the support structure 38 in the furnace 1. As the fan 48 is rotated at a high speed, the carburizing gas or atmosphere is agitated vigorously and forced to flow down through the circulation passages 46 along the inner shell 42 and then to flow upward through the parts 41*a* toward the fan 48.

Because of the forced circulation of the carburizing gas within the heating chamber 2 by the fan 48, the furnace temperature may be maintained uniformly throughout the furnace 1, and the carburizing gas may be also uniformly agitated and circulated through the heating chamber 2 so that the parts 41*a* may be satisfactorily carburized to meet the most exacting engineering requirements.

Next referring to FIG. 6 the mounting of the fan motor 58 will be described. The pressure vessel 34 is provided with a top opening 62 fitted with an annular flange 63, and the cover 64 is vacuumtightly joined to the annular flange 63.

The vacuum chamber 57 mounted on the cover 64 includes an outer shell and an inner shell. The outer shell consists of a cylindrical pedestal 65 mounted on the cover 64 and provided with an upper end flange 67 and a bell-shaped shell 66 with a lower end flange 68 securely and vacuumtightly joined to the upper end flange 67 of the pedestal 65 with a base 69 interposed between the flanges 67 and 68. The inner shell consists of a pedestal 71 rigidly mounted on the base 69 and a shield cover 73 securely and liquid-tightly joined to the pedestal 71 with a fan motor mounting plate 72 interposed therebetween. The fan motor 58 is mounted on the mounting plate 72 within the shield cover 73 and is electrically connected to a terminal plate 70 on the top of the bell-shaped shell 66 through lead-in wires extended through an opening 73*a* formed through the top of the shield cover 73.

The opening 73*a* may be also used for feeding a cooling medium 74 such as an insulating cooling oil into the shield cover 73 to immerse the fan motor 58, and a water cooling coil 75 is disposed within the shield cover 73 in order to cool the cooling oil 74 normally.

A drive shaft 76 of the fan motor 58 is extended downwardly through a hole formed through the mounting plate 72 into the pedestal 71, and a mechanical seal 77 is fitted over the drive shaft 76 and is mounted on the undersurface of the mounting plate 72 in order to prevent the leakage of the cooling oil 74 in the shield cover 73 into the pedestal 71. The rotary shaft 51 of the fan 48 is extended upwardly through a collar 84 disposed within the water jacket 60 into the vacuum chamber 57, is supported by upper and lower bearings 78 and 79 and has its upper end securely joined to the lower end of the drive shaft 76 of the fan motor 58 with a joint 80. The heat received from the high-temperature carburizing atmosphere in the heating chamber 2 by the fan 48 and transmitted through the rotary shaft 51 thereof is effectively dissipated to the cooling water circulating through the water jacket 60 the bottom of which is spaced apart by a suitable distance by a heat insulating ring 85.

Within the outer pedestal 65, an inverted-cup-shaped oil thrower 82 is securely fitted over the rotary shaft 51 of the fan 48 and an annular ring 83 is disposed on the cover 64 coaxially of the rotary shaft 51 so as to define an oil reservoir 83*a* between the annular ring 83 and the interior wall of the pedestal 65.

The vacuum chamber 57 is communicated with the vacuum vessel 34 through communication passage (not shown) so that the pressure in the vacuum chamber 57 may be equal to the pressure within the pressure vessel 34. The inner pedestal 71 is formed with openings 81 through which the joint 80 may be removed out of the inner pedestal 71. As a result, the pressure acting on the surface of the cooling oil 74 in the shield cover 73 is same with the pressure acting on the mechanical seal 77 so that the highly reliable sealing by the mechanical seal 77 may be ensured.

In operation, the degree of vacuum within the vacuum chamber 57 in which is enclosed the fan motor 58 is same with the degree of vacuum in the vacuum vessel 34 because they are intercommunicated with each other. Upon rotation of the fan motor 58 which is always cooled by the cooling oil 74 which in turn is cooled by the cooling water circulating through the cooling coil 75, the fan 48 is rotated at a high speed so that the carburizing atmosphere in the heating chamber 2 is agitated and circulated. The heat received by the blades 49 and the hub 50 and transmitted through the rotary shaft 51 of the fan 48 is dissipated into the cooling water circulating through the water jacket 60. Thus the fan motor 58 is not adversely affected from the high-temperature carburizing atmosphere in the heating chamber 2. Furthermore the fan motor 58 is immersed into and cooled by the cooling medium or oil 74 in the shield cover 73 so that even under extremely severe operating conditions; that is, at a high temperature and a highly reduced pressure, the abnormal temperature rise of the windings of the fan motor 58, the discharges or sparks between the windings and the insulation breakdown due to the carbon particles floating in the furnace atmosphere may be avoided.

The leakage of the cooling medium or oil 74 from the shield cover 73 into the pedestal 71 is effectively prevented by the mechanical seal 77. Furthermore as described above the pedestal 71 communicated through the openings 81 and the opening 73*a* at the top of the shield cover 73 with the latter so that the pressure acting on the cooling oil in the shield cover 73 is same with the pressure acting on the undersurface of the mechanical seal 77. Moreover in order to encounter the leakage of the cooling oil 74 from the shield cover 73 into the pedestal 71, the oil thrower 82 is fitted over the rotary shaft 51 of the fan 48 so that the leaking oil is collected into the oil reservoir 83*a* without flowing along the rotary shaft 51 into the vacuum vessel 34.

The novel features, effects and advantages of the vacuum carburizing furnace in accordance with the present invention may be summarized as follows:

(1) The concentration of $CH_4$ or carburizing gases as well as the pressure of the carburizing atmosphere ($CH_4$ diluted with $N_2$) may be continuously controlled for optimum carburization so that parts or articles may be given a uniform case depth and consequently the qualities of the products may be remarkably improved. In addition, the reliable and dependable operation of the vacuum carburizing furnace may be ensured.

(2) The infrared analyzer readily available in the market may be advantageously employed, and the two-position valves such as solenoid-operated valves which may assume only the closed and open positions may be used so that the use of very expensive servo valves which may adjust the degree of opening can be eliminated. The relatively inexpensive pressure responsive switch which is also readily available in the market may be used as pressure sensing means or pressure sensor. As a consequence, the process control based on complex analog computations may be not necessary, but the control system may consist only of sequence circuits incorporating the solenoid-operated valves and timers. As a results, the control system may be much simplified in construction and there may be provided a vacuum carburizing furnace which is very simple in construction, reliable in operation, easy in maintenance and inexpensive to fabricate.

(3) The partition walls are disposed within the heating chamber so as to define the furnace gas circulation passages through which the furnace gas is forced to circulate. As a result the furnace gas may be uniformly agitated, circulated and made into contact with the parts to be carburized so that the efficiency of carburization may be much improved.

(4) The parts of the fan are all made of a material such as a reinforced synthetic graphite not subjected to the carburization so that they may effectively withstand the high-temperature carburizing atmosphere in the furnace. As a result, the vacuum carburizing furnace may be fabricated at less costs, and the maintenance of the furnace may be much facilitated.

(5) The fan motor is disposed within the vacuum chamber at the pressure same with the pressure in the vacuum vessel in which is disposed the heating chamber. Furthermore the fan motor is immersed in the cooling medium which in turn is always cooled by the cooling water. As a consequence the explosion of the inflammable carburizing atmosphere at a reduced pressure due to the spark from the windings of the fan motor may be positively avoided.

(6) Since the fan motor is immersed in the cooling medium and is enclosed within the vacuum chamber, the fan motor which operates at a reduced pressure may be forced cooled so that even at a reduced pressure the fan motor may be driven for a long time at a high speed. In addition, the vacuum chamber in which the fan motor is enclosed may be easily mounted on the vacuum vessel so that the positive agitation and circulation of the carburizing atmosphere may be ensured. Furthermore the maintenance of the fan and fan motor may be much facilitated. Moreover the leakage of the cooling medium in the shell enclosing the fan motor adjoined the pedestal may be positively avoided. Last but not the least, the adverse thermal effects on the fan motor by the heat transmitted from the blades and hub of the fan through the rotary shaft of the fan physically joined to the drive shaft of the fan motor may be positively avoided by the forced cooling of the rotary shaft by the cooling water circulated through the water jacket surrounding the rotary shaft.

What is claimed is:

1. In a vacuum carburizing furnace wherein a gas feed system provided with a feed valve and an exhaust system provided with an exhaust valve are communicated with a vacuum vessel; pressure sensor means for sensing the furnace pressure and concentration sensor means for sensing the concentration of a carburizing gas in the furnace atmosphere; control means responsive to the output from said pressure sensor means for controlling said exhause valve of said exhaust system and responsive to the output from said concentration sensor for controlling said feed valve of said gas feed system, whereby the concentration of said carburizing gas in said furnace atmosphere as well as the furnace pressure may be optimumly controlled, partition walls made of a material not subjected to the carburization disposed in a heating chamber of said vacuum carburizing furnace and spaced apart by a suitable distance from the respective opposing interior side walls of said heating chamber so as to define circulation passages between said partition walls and said interior side walls; and a fan having its parts made of a material not subjected to the carburization disposed above said circulation passages so that the furnace or carburizing atmospheric gases may be forced to circulate through said circulation passages and parts or articles to be carburized which are charged into said furnace and held in the space defined between said partition walls.

2. A vacuum carburizing furnace as set forth in claim 1 wherein a fan motor for driving said fan is enclosed within a shield cover means and immersed in a cooling medium contained in said shield cover means; and the degree of vacuum in said shield cover means is always maintained the same as the degree of vacuum in said heating chamber.

3. A vacuum carburizing furnace as set forth in claim 1 wherein a rotary shaft of said fan is extended through a water jacket.

4. A vacuum carburizing furnace as set forth in claim 2 wherein a rotary shaft of said fan is extended through a water jacket.

* * * * *